United States Patent [19]

Morrison

[11] Patent Number: 4,787,516

[45] Date of Patent: Nov. 29, 1988

[54] SELF-SEALING PIERCED EARRING AND OTHER ARTICLE SUPPORT PANEL

[76] Inventor: Willard L. Morrison, 1896 Meadowbrook Dr., Winston-Salem, N.C. 27104

[21] Appl. No.: 142,562

[22] Filed: Jan. 11, 1988

[51] Int. Cl.[4] ..... A47F 7/02; A47F 7/03; A47F 5/08

[52] U.S. Cl. ..... 206/566; 206/45.14; 206/205; 206/524.3

[58] Field of Search ..... 206/45.14, 45.19, 566, 206/524.3, 205

[56] References Cited

U.S. PATENT DOCUMENTS

| | | | |
|---|---|---|---|
| 2,861,682 | 11/1958 | Hatcher | 206/566 X |
| 4,181,224 | 1/1980 | Aber | 206/45.14 |
| 4,223,783 | 9/1980 | Marshall | 206/45.14 |
| 4,413,736 | 11/1983 | Nibling | 206/566 |
| 4,687,103 | 8/1987 | Corbett | 206/566 |
| 4,697,705 | 10/1987 | Garganese | 206/566 X |

*Primary Examiner*—William Price

*Attorney, Agent, or Firm*—Rhodes, Coats & Bennett

[57] ABSTRACT

A storage and display device particularly adapted for use in storing pierced earrings, but also useful for display purposes such as bulletin boards, includes an article-supporting panel formed of sheet or board stock elastomeric, self-sealing material having a characteristic resilience which provides for the insertion of a piercing component into the panel and for the closure of the resulting puncture when the piercing component is removed from the panel. In one embodiment for earring storage, an antimicrobial compound is added to the elastomeric material to provide means for disinfecting the earring wires during storage.

7 Claims, 1 Drawing Sheet

SELF-SEALING PIERCED EARRING AND OTHER ARTICLE SUPPORT PANEL

BACKGROUND AND SUMMARY OF THE PRESENT INVENTION

The storage of pierced earrings in an organized manner is problematic because of the need for ready inspection and accessibilty to both the earrings and accompanying friction retainers. The most popular known approaches to storage are jewelry boxes and storage racks. In jewelry boxes the earrings usually are placed loosely in segmented trays, or occasionally are mounted on perforated panels in the jewelry box. Storage racks are based on the principle of the perforated panels in jewelry boxes; except that the storage racks are generally free-standing. Most known storage racks are constructed from a molded acrylic, Plexiglas TM, or other such sheet polymeric material. The racks are constructed such that the sheets or panels are perforated and are mounted in a position allowing the earring posts or wires to be inserted through the perforations and held therein by placing the friction retainers on the post or wire.

Problems with such storage racks include the need to position the racks for accessibility to front and back; difficulty in positioning earrings thereon as desired because the perforations ar fixed; and the fact that such racks must generally be in an open area for accessibility, therefore leaving the earrings open and exposed.

Other types of racks include expanded foam panels into which the earrings are inserted. However, each time an earring is inserted into the panel, the resulting puncture is permanent. Therefore the panels have a relatively short period of usefulness. Additionally, such foams are usually very porous and will not hold and support heavy earrings in a secure fashion.

The present invention is directed to a means for storing pierced earrings of any style or type; and can also be adapted for use as a bulletin board or a board on which a variety of articles can be mounted. In the preferred embodiment the earring storage/display means is broadly comprised of a planar sheet or panel of foamed elastomeric material having inherent self-sealing characteristics. As such, earrings having a post or wire mount can be inserted into the panel and the elastomeric material will close around the post or wire, holding it therein. When the earring is removed the resulting puncture is automatically closed by the inherent elasticity of the foam.

The present earring storage device proves quite effective in overcoming the above-discussed problems with previous methods of storage in that the earrings may be stored in any desired arrangement on the panel because there are no fixed perforations; the panel can be positioned in virtually any desired location because there is no need to access the back; and smaller models of panels can be included in jewelry boxes or cases if desired.

As a further improvement of the storage panel, an antimicrobial product can be added to the elastomeric material at the time of molding or extruding for the purpose of disinfecting the earring posts or wires while in the panel. The antimicrobial ingredient is best generally described as bacteriostatic, having the ability to inhibit growth of common bacterial forms; or having the ability to destroy the bacteria immediately on contact or on contact lasting a reasonable time.

For other types of storage and display purposes the elastomeric panels are useful as bulletin boards, display boards, etc. The panels can be framed or otherwise supported for use as a conventional bulletin/display board, receiving any piercing means of mounting or attaching papers or other articles thereon. When the tack, staple or other such attachment means is removed, the panel's self-healing character closes the puncture. Thus, unlike cork, wood, foam, or other such conventional material, the present invention substantially improves the life expectancy of such bulletin or display boards.

The primary objectives of providing a display or storage panel having self-healing surface characteristics are achieved by the present invention; as is the objective of a highly improved means for storing pierced earrings. Other and further advantages and objectives will become apparent as the following detailed description is studied in conjunction with the accompanying drawings.

DETAILED DESCRIPTION OF A PREFERRED EMBODIMENT

Figure 1:
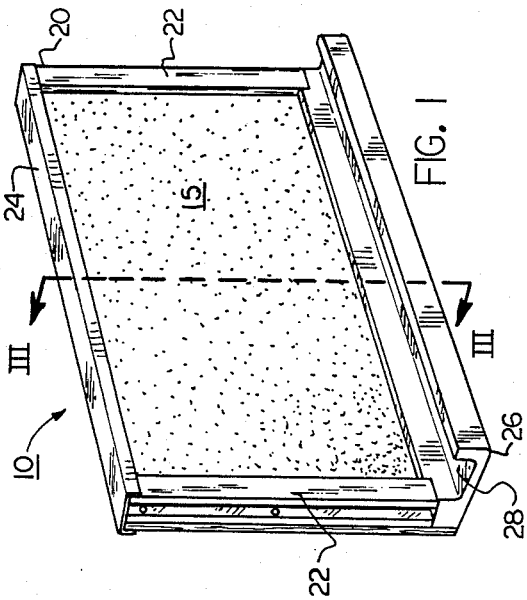
FIG. 1 is a perspective view of one embodiment of the invention, which embodiment might be utilized as a bulletin/display board or for storage of earrings or other articles.

Looking first at FIG. 1 the display or storage panel 10 is constructed for use as a bulletin board, earring storage, or other article storage or display wherein a piercing-type component can be used to support an article or object on the panel.

Figure 2:
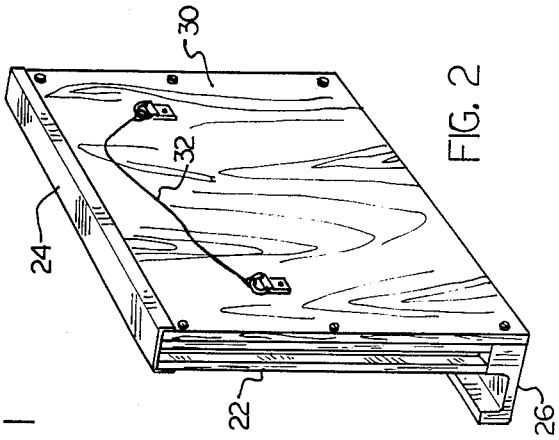
FIG. 2 is a rear perspective of the embodiment of FIG. 1.

The invention 10 is substantively comprised of an article-supporting panel 15 surrounded by a frame 20. The embodiment shown in FIGS. 1 and 2 is designed for use by hanging on the wall or sitting on a flat surface. When sitting on a table or other such flat support, the panel is supported on the lower surface of the frame 20 as will be explained in detail below. As shown, frame 20 includes side members 22, a top member 24, and a bottom member 26. A backing plate 30 is positioned behind the article support panel 15, attached by screws 34 or other means to the frame members 22,24 and 26. To hang on a vertical surface, hanger means 32 can be attached either to the frame, or as shown in FIG. 2, to the rear of the backing plate 30.

The article supporting panel 15 is comprised of a sheet of stock material of a type having self-sealing, or sometimes referred to as "self-healing," qualities when pierced or punctured with a sharp object. Such materials are generally foam products chosen from a group of elastomers which include both polymeric resins and latex and rubber compounds. The material chosen must have an elastic resilience which grips the piercing member upon insertion into the panel and, upon removal of the piercing member, contracts to close the puncture.

Among the many such materials available, one is a hybrid form of polyurethane which has a chemical composition resembling polyether. The stock foam material is a product of Scott Paper Company of Chester, Pa. and is sold under the catalog designation of Scott S250-140. The density of the Scott material is approximately 2.5 pounds/cubic foot, which gives the panel the capacity to grip earrings or other objects tightly enough to prevent their falling off the panel even when the panel is inverted or tipped over.

A second example of a material which is satisfactory for use in constructing panel 15 is a product of Velcro USA, Inc., Manchester, N.H., sold under the catalog designation of Laminate 3920. This Velcro USA product is a "Perm-X" foam material which has been laminated to a velcro TM -like, nylon loop material for aesthetic purposes. The nylon loop material itself has some self-sealing properties, but would likely be used in embodiments where the appearance of the bare foam material would be less than desirable.

It is of course recognized that other similar materials are available and would be appropriate for use in forming the panel member 15. As previously described, the critical characteristics of the material are those of inherent self-sealing elasticity, and sufficient density to securely grip and hold the earrings or other articles.

Figure 3:
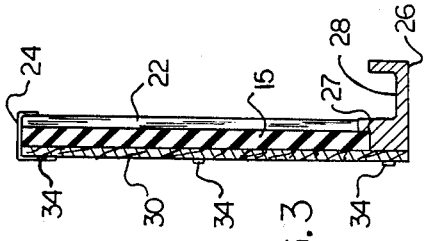
FIG. 3 is a cross-sectional view of the embodiment of FIG. 1 taken along lines III—III.

Returning to the discussion of the embodiment shown in FIGS. 1 and 2, and in cross-section in FIG. 3, where used for storage of earrings, the foam panel 15, which is approximately ⅝" thick, receives the earrings thereon by insertion of the earring post (not shown) or earring wire 42 into the panel 15. As mentioned, the post or wire punctures the foam, but the resiliency of the foam ensures that the foam grips around the post or wire to tightly hold therein. The earrings can be organized on the panel in any fashion desired, and reorganized as frequently as desired without destroying the appearance or function of the panel material. This capability is due to the self-sealing characteristics of the foam material which provides for the contracting and closing of the puncture as the post or wire is withdrawn, thus leaving the panel unscarred.

It is not necessary for the friction retaining member 45 to be placed on the earring post in order to hold the earring on the panel 15. The retainers 45 can be stored in a separate container, or in the embodiment of FIG. 1, the retainers can be placed in the open channel portion 28 of frame bottom member 26. For storage of clip-on earrings, the side members 22 of the frame, are constructed to receive earrings 47 thereon by clipping the earring on the facial surface of the side member.

The frame members are preferably formed of an extruded polystrene, although they could be made from other stock such as metal or wood. As illustrated the bottom member 26 is extruded in the form of an elongated member having a notched portion 27 into which the panel 15 is seated, and an open channel 28 positioned forwardly of the face of panel 15. The channel 28 is deep enough to contain a plurality of earring retainers 45 therein; and the entire bottom member 26 is of a width, front to rear, sufficient to support and balance the framed panel and inhibit the panel's toppling over.

As previously described, the backing plate 30 is attached by screws 34 to the frame portion (see FIG. 3 cross-section) to support and stabilize the frame and the panel against warping and bending. The plate 30 is formed of an rigid sheet material such as lucite or other polymers, masonite, wood, and the like. In some of the smaller embodiments, backing plate 30 might be omitted, particularly where warping of the frame and panel is not a significant problem.

Figure 4:
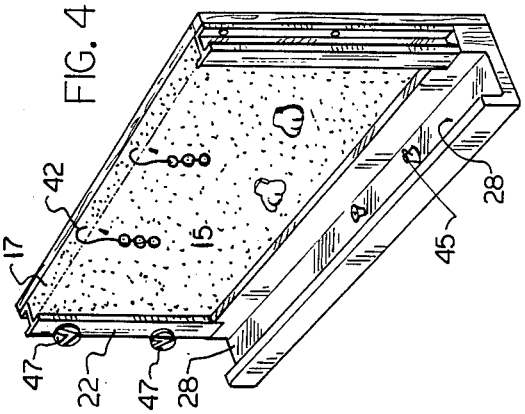
FIG. 4 is a perspective view of an embodiment used specifically for storage of pierced earrings.

Additionally, in some embodiments it is anticipated that the frame top member 24 will be omitted, leaving the panel 15 supported by the remaining side and bottom frame members and backing plate 30. With the top member omitted, the upper edge of panel 15 is left exposed to serve as a ledge 17 (see FIG. 4) to receive earrings of the type having a curved wire 42. While the wires 42 can be inserted anywhere over the face of panel 15, the exposed ledge 17 improves the ease with which the wires can be inserted into the foam without unnecessary bending or tension on the wires.

In the embodiments specifically designed for use with earrings, it is preferred to introduce an antibacterial agent into the foam stock in order to provide some disinfectant activity which is applied to the earring posts or wires during periods of storage on the board. It is a normal occurrence for earring posts or wires, if not kept meticulously clean, to cause irritation to the ear. The use of an antimicrobial agent in the foam will destroy most if not all the bacteria which is on the earring post or wire. In fact, if the post or wire member is inserted along its full length into the panel, such that the back of the earring is positioned against the panel, some disinfectant activity is also applied to the back of the earring itself.

The addition of the antibacterial agent to the foam material is preferably done at the time of molding or extruding. When accomplished at this stage the additive will be substantially uniformly distributed throughout the panel, thereby improving the likelihood that the earrings will be exposed to the antimicrobial agent when mounted anywhere on the panel.

Criteria for selecting the agent, as previously described, is that the agent have the ability to inhibit growth of common infectious bacteria such as staphylococcus aureus and the bacterial capability to kill the bacteria on contact over a reasonable minimal time period. Additionally, the antimicrobial agent should be able to withstand the temperatures required in the production of a specific foam material without degradation or evaporation of the agent.

Two examples of satisfactory antimicrobial agents are: (a) 3,4,5-tribromosalicylanide; and (b) 5-chloro-2-(2,4-dichlorophenoxy) phenol. However, a third example, and the preferred for use in the present invention is 2,4,4'-trichloro-2'-hydroxydiphenyl ether; commonly known by the tradename Irgasan DP-300, produced and marketed by Ciba-Geigy Co., Ardsley, N.Y. A foam material which contains this preferred antibacterial agent is available from Microban Products Co., Winston-Salem, N.C.

Figure 5:
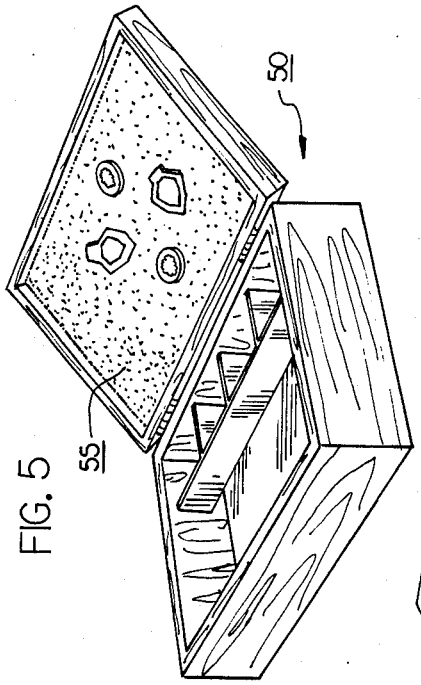
FIG. 5 is a perspective view of the present invention as it might be incorporated into a conventional jewelry case.

Looking finally at FIG. 5, the earring supporting panel 55 is shown mounted in a conventional jewelry box 50. The panel 55 is an appropriately dimensioned sheet of the above-described self-sealing foam material which has been mounted in a selected area of the jewelry box to receive pierced earrings thereon. The earring friction retainers can be stored in a separate compartment. The panel 55 might be placed in a drawer or on the inside of the hinged top of a different type of jewelry box.

Further, it is anticipated that other and further modifications of the present invention might be made while remaining within the scope of the claims below.

What is claimed is:

1. A storage and display device for use in the storing and display of articles of the type which include a piercing component that provides a means for supporting the article on a selected surface; said device including:

(a) a panel member for receiving and supporting articles to be stored or displayed thereon; said panel comprising a sheet of elastomeric, self-sealing material having a characteristic resilience which provides for the insertion of a piercing component into said panel and for the closure of the puncture when the piercing component is removed from the panel; said panel having a prescribed shape and size;

(b) a means for supporting said panel in a selected position;

whereby selected articles are stored or displayed by inserting the piercing component into the surface of said panel and, when removed, said elastomeric sealant material seals the punctured area.

2. A device for storing earrings of the type worn by those persons having pierced ears, which earrings include a wire or post component for insertion into the pierced area of the earlobe; said device including:

(a) a panel member for receiving and supporting a plurality of earrings thereon; said panel comprising a sheet of elastomeric, self-sealing material having a characteristic resilience which provides for the insertion of an earring wire into said panel and for the automatic closure of each puncture when the earring wire is withdrawn from said panel;

(b) means for supporting said panel in a selected position;

whereby earrings are mounted on said panel by insertion of the earring wire into said panel, and when the earring is removed the puncture caused by the wire closes due to the inherent resilience of said sheet material.

3. A device for storing earrings according to claim 2 wherein said means for supporting said panel in a selected position is comprised of:

(a) a frame which surrounds a prescribed portion of the edges of said panel;

(b) support means associated with said frame for supporting said frame and said panel in a substantially upright position.

4. A device for storing earrings according to claim 3 and further including hanging means associated with said frame for hanging said device on a vertical support surface.

5. A device for storing earrings according to claim 3 further including a support plate underlying one planar surface of said panel for supporting said panel in a substantially rigid position and improving the supporting capacity of the panel.

6. A device for storing earrings according to claim 2 wherein said panel of elastomeric material further includes a prescribed antimicrobial composition added thereto for disinfecting the earring wires inserted therein.

7. A device according to claim 6 wherein said prescribed antimicrobial composition is 2,4,4'-trichloro-2'hydroxydiphenyl ether.

* * * * *